US007920815B2

(12) United States Patent
Miyake

(10) Patent No.: US 7,920,815 B2
(45) Date of Patent: Apr. 5, 2011

(54) FIXING DEVICE WITH EASILY ATTACHABLE HEATER FOR USE IN IMAGE FORMING APPARATUS AND IMAGE FORMING APPARATUS PROVIDED WITH THE SAME

(75) Inventor: Takashi Miyake, Osaka (JP)

(73) Assignee: Kyocera Mita Corporation (JP)

( * ) Notice: Subject to any disclaimer, the term of this patent is extended or adjusted under 35 U.S.C. 154(b) by 1026 days.

(21) Appl. No.: 11/787,010

(22) Filed: Apr. 13, 2007

(65) Prior Publication Data

US 2007/0242989 A1 Oct. 18, 2007

(30) Foreign Application Priority Data

Apr. 18, 2006 (JP) ..... 2006-114655

(51) Int. Cl.
*G03G 15/20* (2006.01)

(52) U.S. Cl. ..... 399/328; 399/330

(58) Field of Classification Search ..... 399/328, 399/329, 330, 320

See application file for complete search history.

(56) References Cited

U.S. PATENT DOCUMENTS

| | | | | |
|---|---|---|---|---|
| 5,481,350 | A * | 1/1996 | Yasui et al. | 399/328 |
| 6,442,360 | B1 * | 8/2002 | Onodera et al. | 399/122 |
| 2005/0047838 | A1 * | 3/2005 | Uehara et al. | 399/329 |
| 2007/0092311 | A1 * | 4/2007 | Fujimoto | 399/328 |

FOREIGN PATENT DOCUMENTS

| | | |
|---|---|---|
| JP | 7084419 | 3/1995 |
| JP | 9-251253 | 9/1997 |

* cited by examiner

*Primary Examiner* — David M Gray
*Assistant Examiner* — Billy J Lactaoen
(74) *Attorney, Agent, or Firm* — Gerald E. Hespos; Michael J. Porco

(57) ABSTRACT

A fixing device is provided with a pair of a fixing unit and a pressing unit for performing fixation of a toner image on a recording sheet; a support frame for supporting the fixing unit and the pressing unit; and a heater for generating heat for the fixation, the heater having a cylindrical shape, and being provided with an insulator on at least one of the opposite ends thereof, the insulator having a retaining space operable to fixedly engage with a portion of the support frame. This facilitates the attachment of heaters on the support frame.

16 Claims, 12 Drawing Sheets

FIXING DEVICE WITH EASILY ATTACHABLE HEATER FOR USE IN IMAGE FORMING APPARATUS AND IMAGE FORMING APPARATUS PROVIDED WITH THE SAME

BACKGROUND OF THE INVENTION

1. Field of the Invention

This invention relates to a fixing device for use in an image forming apparatus and an image forming apparatus provided with the same.

2. Description of the Related Art

In electrophotographic image forming apparatus, such as copying machines, printers, and facsimile machines, a toner image formed on a photoconductive drum is transferred onto a recording sheet, and fixed onto the recording sheet by an application of heat and pressure to the recording sheet.

A fixing device used in such image forming apparatus includes a fixing roller and a pressing roller made in pressing contact with the fixing roller. Further, a rod-shaped heater is provided in the fixing roller, the pressing roller, or other heating member to heat the fixing roller to have a predetermined temperature. To melt toner particles adhered on a recording sheet under suitable conditions and accomplish good fixation, it is necessary to keep the fixing roller at a predetermined surface temperature. The surface temperature of the fixing roller is controlled by detecting a surface temperature of the fixing roller by a temperature sensor such as a thermistor directly or indirectly, and regulating the electric power supply to the heater in accordance with a detected temperature.

The heater is passed through the fixing roller or other heating member, and the both ends of the heater are supported on a support frame. In consideration of thermal expansion of the heater, as disclosed in Japanese Unexamined Patent Publication No. HEI 9-251253, one end of the heater is expandably placed in the support frame to allow a thermal expansion of the heater, and the other end of the heater is fixedly attached to the support frame by using a bracket and screws. One end of the heater is fixedly attached to the support frame to suppress the shifting of the heater in an axial direction due to a thermal expansion so that a heating region (irradiation region) of the heater can be reliably detected by the temperature sensor. However, this mechanical attachment of the heater is troublesome because the bracket must be delicately set at a given position and the screws must be rotated in a limited space.

Recently, two or more heaters are provided in a fixing roller or other heating member for the reason of raising the surface temperature of the fixing roller in a shorter time or other considerations. In the provision of a plurality of heaters, these heaters are required to be arranged as close to the axis of the fixing roller or other member as possible to ensure uniform heating of the entire surface of the fixing roller. However, the arrangement of the plurality of heaters closer to each other causes the respective ends of the heaters to become closer, consequently requiring complicated and delicate handling of the respective power transmission wires extending out of the heaters, and resulting in some difficulty in the assembling operation of a fixing device.

In the conventional way, further, the plurality of heaters are individually attached to the support frame. Accordingly, a delicate attention is required to attach the plurality of heaters keeping the heaters at a predetermined relative spatial position.

Moreover, there have been proposed a heater provided with insulators on the both ends thereof. However, it is difficult to arrange these heaters in a horizontal direction or vertical direction closer to one another because the insulator of one heater is likely to come into contact with the insulator of another heater.

SUMMARY OF THE INVENTION

It is an object of the present invention to provide a fixing device for use in an image forming apparatus and an image forming apparatus which are free from the problems residing in the prior art.

It is another object of the present invention to provide a fixing device for use in an image forming apparatus which makes it possible to attach a heater more easily and reliably.

It is still another object of the present invention to provide a fixing device for use in an image forming apparatus which makes it possible to attach a plurality of heaters keeping a necessary relative space more easily and reliably.

According to an aspect of the present invention, a fixing device is used in an image forming apparatus, and includes a pair of a fixing unit and a pressing unit for performing fixation of a toner image on a recording sheet; a support frame for supporting the fixing unit and the pressing unit; and a heater for generating heat for the fixation. The heater has a cylindrical shape, and is provided with an insulator on at least one of the opposite ends thereof. The insulator has a retaining space operable to fixedly engage with a portion of the support frame.

These and other objects, features and advantages of the present invention will become more apparent upon a reading of the following detailed description and accompanying drawings.

DETAILED DESCRIPTION OF THE PREFERRED EMBODIMENTS

Figure 1:
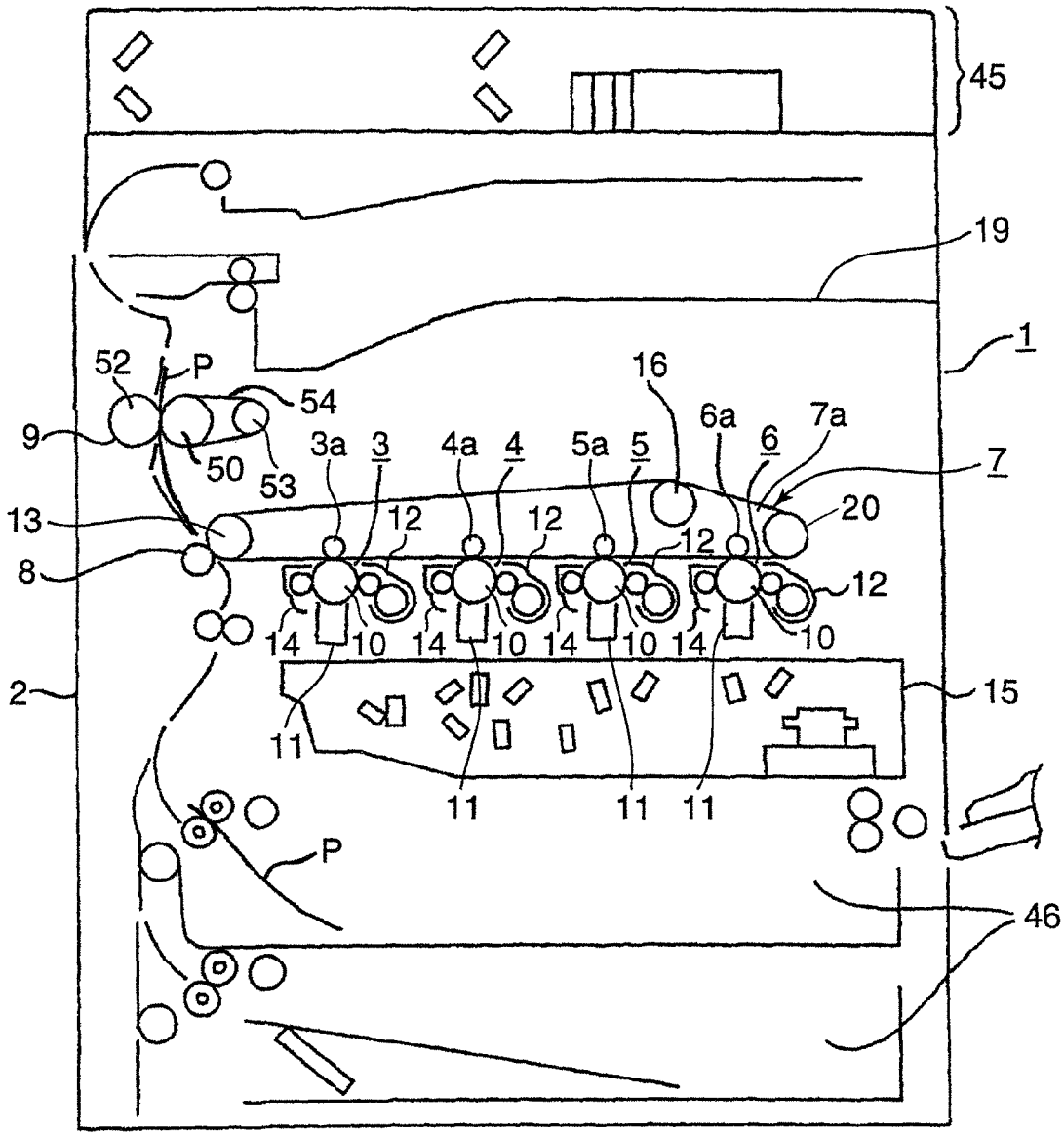
FIG. 1 is a schematic diagram showing an internal configuration of an image forming apparatus embodying the present invention.

First of all, an image forming apparatus embodying the present invention will be described. Referring to FIG. 1 showing an internal configuration of a copying machine as an image forming apparatus, the copying machine 1 is a tandem electrophotographic type color copying machine, and includes a housing 2, a document reading section 45 above the housing 2, four image forming modules 3, 4, 5, and 6 arranged in a middle level of the housing 2, an intermediate transfer belt unit 7 arranged above the image forming modules 3, 4, 5, and 6 and having a transfer endless belt 7*a*, a laser scanning unit 15 below the image forming modules 3, 4, 5, and 6, two recording sheet cassettes 46, 46 for storing and supplying recording sheets, a primary transferring roller 8 adjacent to one side of the intermediate transfer belt unit 7, and a fixing device 9 on downstream of the primary transferring roller 8.

The document reading section 45 is provided with an exposure lamp and an optical system including lenses and mirrors. Reading of a document bearing letters, an image, and/or the like is executed as follows. A document is placed on a placement glass facing downward, and is pressed by a pressing member. The exposure lamp is moved to irradiate an entire front surface of the document. Light rays reflected from the document are guided to a photoelectric reader unit by the way of lenses and mirrors. The reflected light rays are color-separated into primary color components by color separation filters. Each color component is photoelectrically converted to a time-series digital electrical signal or color image signal, and then sent to the laser scanning unit 15.

Figure 2:
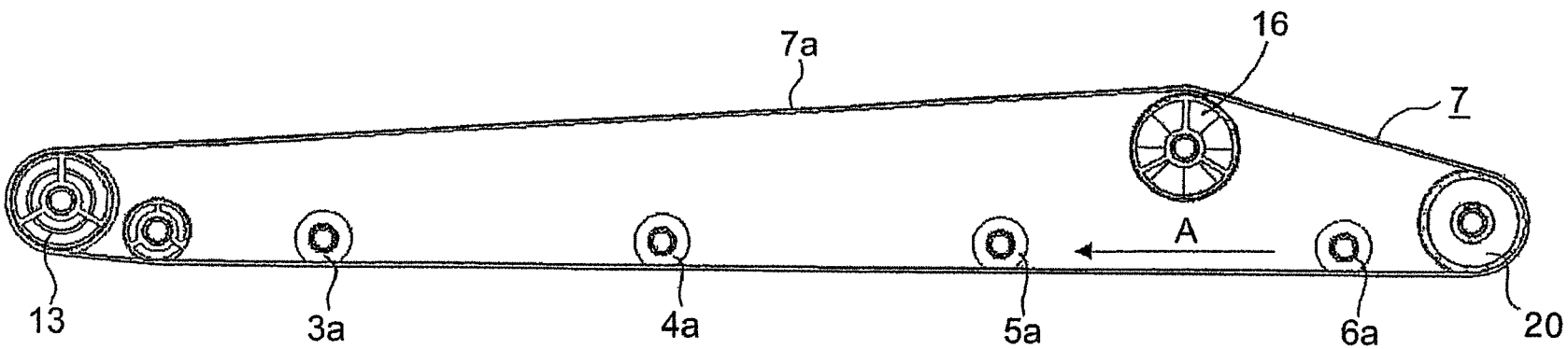
FIG. 2 is a front view of an intermediate transfer belt unit used in the image forming apparatus.

The image forming modules 3, 4, 5, and 6 have the same basic construction, and are adapted for producing a black image, a yellow image, a cyan image, and a magenta image, respectively. Each image forming module 3 (4, 5, or 6) includes a photoconductive drum 10, a charger 11, a developing unit 12, a first transferring roller 3*a* (4*a*, 5*a*, or 6*a*), and a cleaning unit 14. The photoconductive drum 10 uses an amorphous silicon as a photoconductive material. As shown in FIG. 2, the first transferring roller 3*a* (4*a*, 5*a*, or 6*a*) is arranged inside of the transfer belt 7*a* of the intermediate transfer belt unit 7, and presses the transfer belt 7*a* against the corresponding photoconductive drum 10.

The laser scanning unit 15 arranged below the image forming modules 3, 4, 5, and 6 directs scanning laser beams to the respective charged photoconductive drums 10 of the image forming modules 3, 4, 5, and 6 to form latent images on the respective photoconductive drums 10.

Referring to FIG. 2, the intermediate transfer belt unit 7 includes a driving roller 13, a driven roller 20, a tension roller 16 which are arranged inside the transfer belt 7*a*. The transfer belt 7*a* is coated with an elastic material layer primarily made of rubber, and moved in the direction of the arrow A by the driving roller 13. The tension roller 16 imparts an appropriate tension to the transfer belt 7*a*. As mentioned above, the respective first transferring rollers 3*a*, 4*a*, 5*a*, and 6*a* of the image forming modules 3, 4, 5, and 6 are arranged inside the transfer belt 7*a*.

The primary transferring roller 8 presses the transfer belt 7*a* against the driving roller 13. A recording sheet P is supplied from the recording sheet cassette 46 to a nip valley between the primary transferring roller 8 and the transfer belt 7*a* at a predetermined timing. During the time when the recording sheet P is advanced in the nip portion between the primary transferring roller 8 and the transfer belt 7*a*, each color toner image formed on the transfer belt 7*a* is transferred onto the recording sheet P.

The fixing device 9 arranged downstream of the primary transferring roller 8 serves to fix the transferred toner images on the recording sheet P. Subsequently, the recording sheet P bearing the fixed toner images is conveyed to a discharge tray 19 formed in the housing 2.

Next, copying operations of the copying machine 1 will be described. The document reading section 45 reads a document to generate color image signals, and then sends them to the laser scanning unit 15. On the other hand, the respective photoconductive drums 10 of the image forming modules 3, 4, 5, and 6 are charged by the chargers 11. The charged photoconductive drums 10 are scanned by laser beams which are generated in accordance with the sent color image signals by the laser scanning unit 15, consequently forming latent images on the respective photoconductive drums 10. The developing units 12 supply their respective color toner particles to the photoconductive drums 10 to thereby develop or form color toner images by the developing units 12.

The formed color toner images are transferred onto the transfer belt 7*a* from the respective photoconductive drums 10 by the first transferring roller 3*a*, 4*a*, 5*a*, and 6*a*. The respective color toner images are transferred onto a recording sheet P conveyed into the nip valley between the primary transferring roller 8 and the transfer belt 7*a*. The recording sheet P transferred with the color toner images is passed through the fixing device 9, and then discharged to the discharge tray 19.

The photoconductive drums 10 and the transfer belt 7*a*, from which the toner images have been transferred, are cleaned by the cleaning unit 14 to remove the remaining toner particles.

In the case of forming a monochromatic image on a recording sheet, a black toner image is formed using only the black image forming module 3.

Next, a construction of the fixing device 9 will be described in more detail. The fixing device 9 comprises a fixing unit including a fixing roller 50 and a pressing unit including a pressing roller 52. A torque transmission endless belt 54 is provided between the fixing roller 50 and a driving motor 53 to thereby drive the fixing roller 50 at a predetermined rotational speed. The pressing roller 52 comes into pressing contact with the fixing roller 50, and receives a torque from the fixing roller 50, thereby rotating following the rotation of the fixing roller 50.

Figure 5:
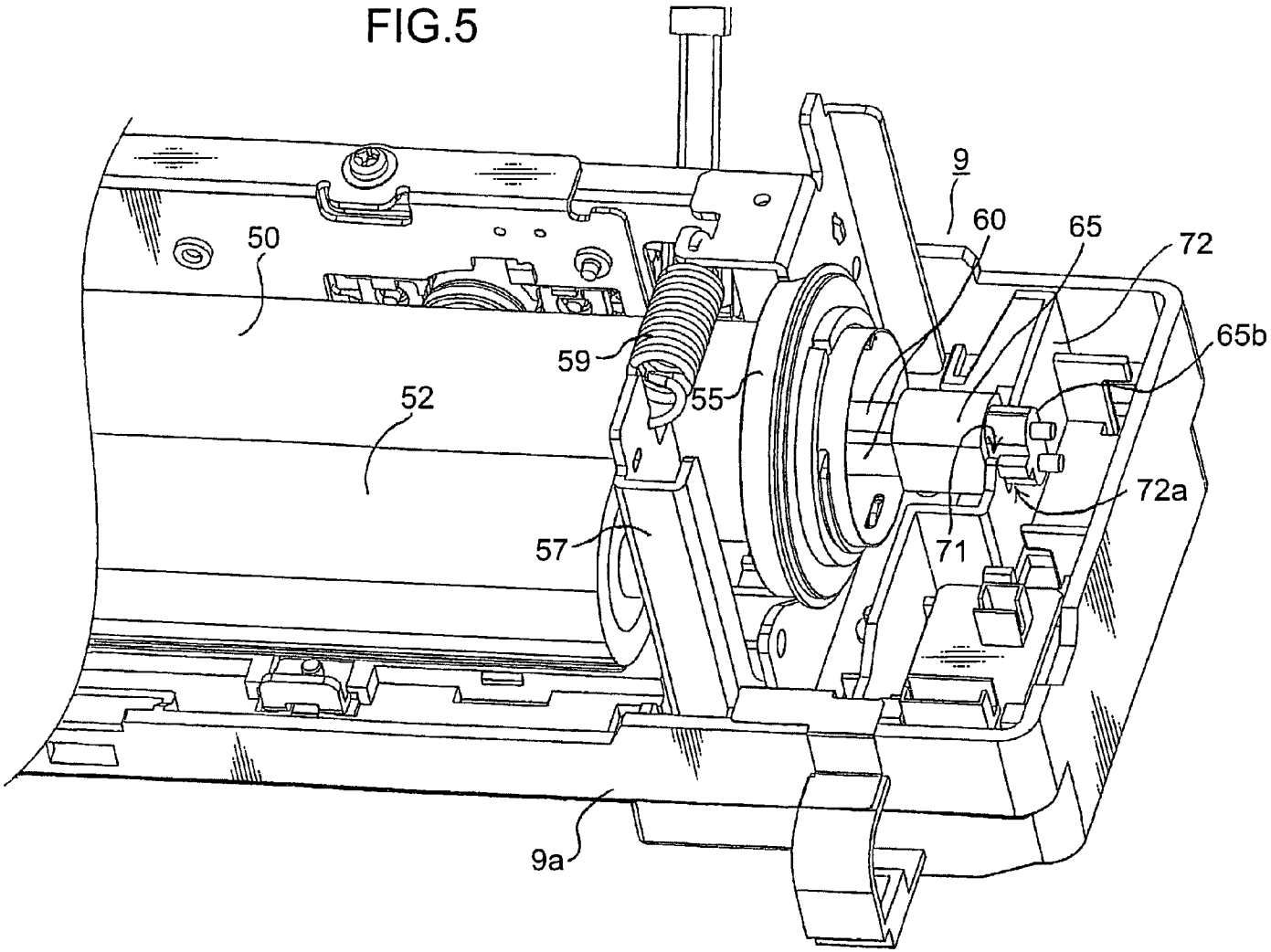
FIG. 5 is a perspective view of an end part of the fixing device, showing a state that the fixing roller and a pressing roller are attached to the support frame.

The fixing roller 50 has a hollow cylindrical shape, and is rotatably supported on the support frame 9*a* by means of bearings 55 mounted on the both ends thereof, as shown in FIG. 5. The pressing roller 52 is rotatably supported on pivotal members 57 which are arranged near the both ends of the pressing roller 52 and pivotally attached on the support frame 9*a*. More specifically, a lower end of each pivotal member 57 is pivotally attached to the support frame 9*a*. An upper end of the pivotal member 57 is urged toward the fixing roller 50 by a coil spring 59. An end of a shaft of the pressing roller 52 is rotatably mounted at an intermediate position of the pivotal member 57. In this way, the pressing roller 52 is made to press against the fixing roller 50 by the coil spring 59. A recording sheet P bearing a transferred toner image is inserted into the nip valley between the fixing roller 50 and the pressing roller 52, so that the toner image is reliably fixed on the recording sheet owing to the heat and pressure of the fixing roller 50 in the course of passing of the recording sheet P between the fixing roller 50 and the pressing roller 52.

Figure 3:
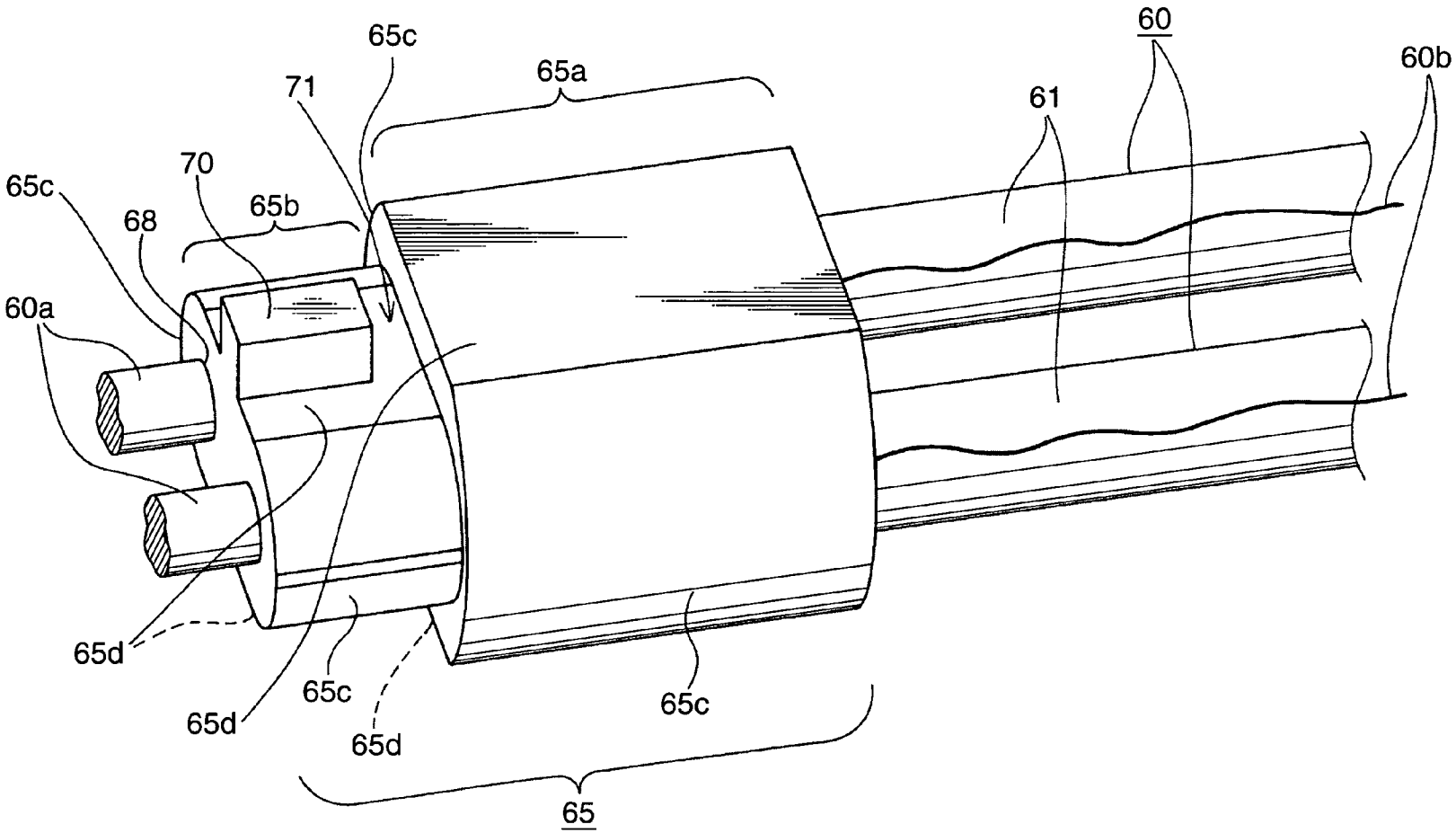
FIG. 3 is a perspective view of an end part of a heater arranged through a fixing roller constituting a fixing device used in the image forming apparatus.

Two heaters 60, 60 are arranged through the fixing roller 50. Each heater 60 has a cylindrical shape extending in parallel with an axis of the fixing roller 50, and is arranged near a center or axis of the fixing roller 50. The heater 60 includes a halogen lamp having a glass tube 61 and a tungsten filament 60*b* provided in the glass tube 61, and insulators 65 provided on both ends of the glass tube 61. The insulator 65 is made from glass, porcelain, or composite polymer materials. As shown in FIG. 3, the respective one ends of the two heaters 60, 60 are integrally unified by the single insulator 65.

Next, attachment of the assembly of heaters 60, 60 to the support frame 9*a* will be described with reference to FIGS. 3 to 6B. The insulator 65 has, as shown in FIG. 3, a large boss portion 65*a* and a small boss portion 65*b*. Two electric power transmission wires 60*a*, 60*a* respectively connected with the tungsten filaments 60*b*, 60*b* are extended out of the insulator 65, and are connected with an unillustrated power source.

The large boss portion 65*a* has a pair of round surfaces 65*c* which project in the opposite directions of passing the axes of the two heaters 60, 60, and a pair of flat surfaces 65*d* which are between the round surfaces 65*c* and parallel with a plane bearing the axes of the two heaters 60, 60. Similarly, the small boss portion 65*b* has a pair of round surfaces 65*c* and a pair of flat surfaces 65*d*.

On one flat surface 65*d* of the small boss portion 65*b* is formed a projection 70 in the shape of a rectangular block in such a manner as to define a groove 71 between an end surface of the large boss portion 65*a* and the block-shaped projection 70. The width of the groove 71 is substantially the same as a thickness of a support wall 72 provided on the support frame 9*a*. The dimension between the opposite flat surfaces 65*d*, 65*d* of the small boss portion 65*b* is substantially the same as a width of a attachment recess 72*a* formed in the support wall 72 of the support frame 9*a*.

Figure 6A:
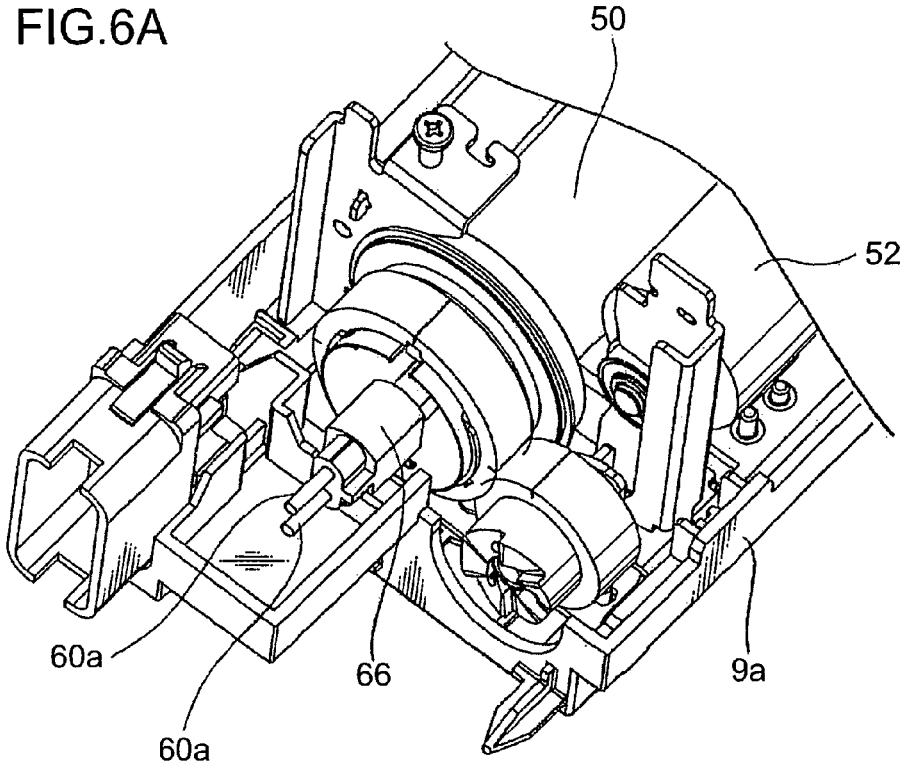
FIG. 6A is a perspective view of the other end part of the fixing device, showing a state that the fixing roller and the pressing roller are attached to the support frame.

As shown in FIG. 6A, another insulator 66 is provided on the other end of the two heaters 60, 60. The insulator 66 has the same configuration as the insulator 65 except for having no retaining groove. The insulator 66 is not formed with such a space as the groove 71. Accordingly, the heaters 60, 60 can slide in an axial direction to absorb a thermal expansion of the heaters 60, 60.

Figure 4:
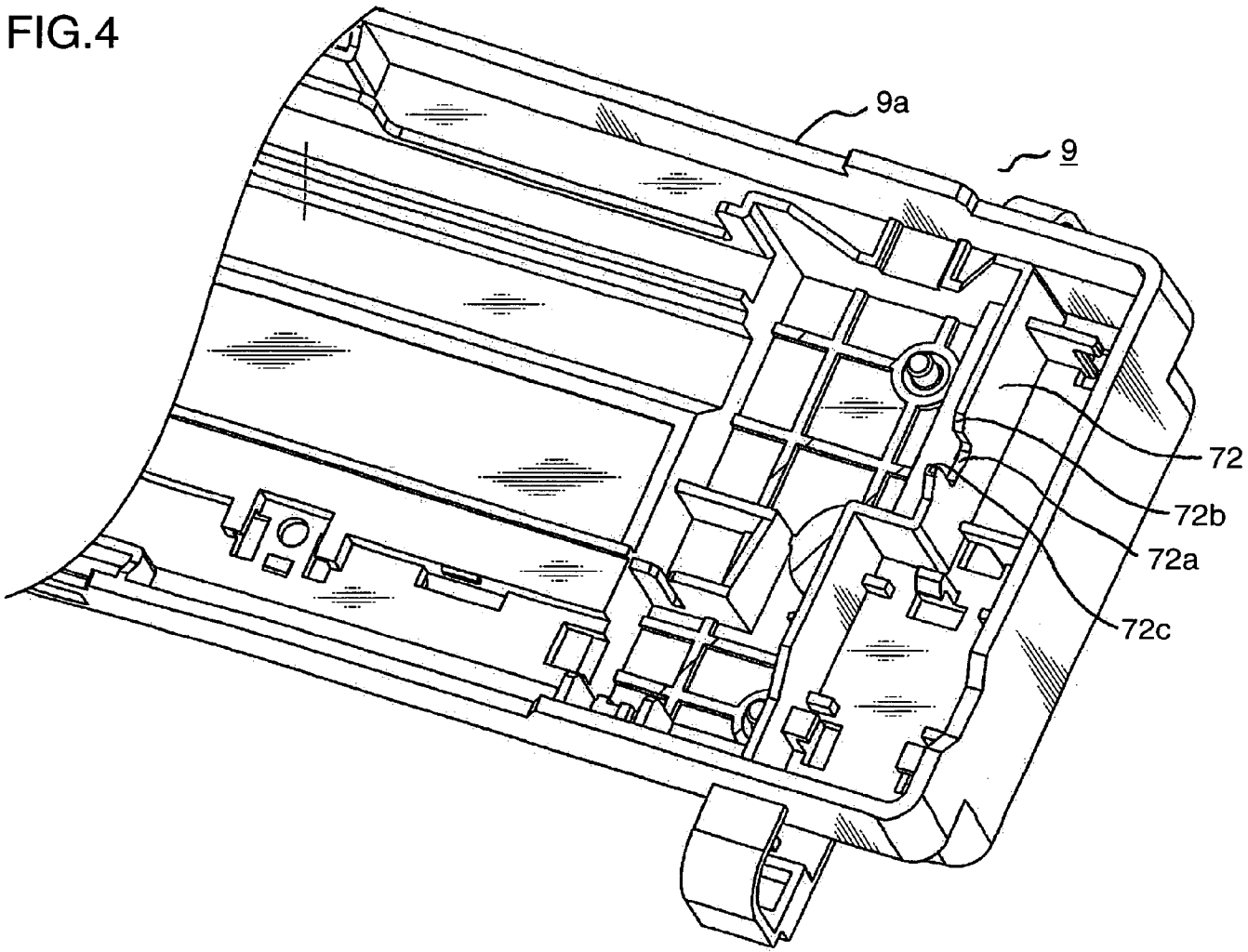
FIG. 4 is a perspective view of an end part of a support frame, showing a fixing roller attachment portion of the support frame.

The support frame 9*a* is formed with support walls 72 at positions corresponding to the both insulators 65 and 66, as shown in FIG. 4. The attachment recess 72*a* is formed in each of the both support walls 72, and adapted for accommodating the insulator 65 (66). The attachment recess 72*a* is formed into a U-shape, and has a slanting cut surface 72*b* on one upper edge and an extensive projection 72*c* on the other upper edge.

For the attachment of the assembly of heaters 60, 60, the small boss portion 65*b* of the insulator 65 is placed in the attachment recess 72*a* of the proximate support wall 72 and the small boss portion of the insulator 66 is placed in the attachment recess 72*a* of the remote support wall 72.

In the proximate support wall 72, as shown in FIG. 5, the extensive projection 72*c* of the support wall 72 engages with the groove 71 defined between the large boss portion 65*a* and the block-shaped projection 70 of the insulator 65. The insulator 65 is kept from moving or sliding in the axial directions and the radial directions because: 1) the dimension between the opposite flat surfaces 65*d*, 65*d* of the small boss portion 65*b* placed in the attachment recess 72*a* is substantially the same as the width of the attachment recess 72*a*; and 2) the width of the groove 71 engaging the extensive projection 72*c* is substantially the same as the thickness of the extensive projection 72*c*. Also, the small boss portion 65*b* of the insulator 65 is inserted into the attachment recess 72*a* after sliding the flat surface 65*d* over the slanting surface 72*b*. This facilitates the attachment of the insulator 65 into the attachment recess 72*a* of the support wall 72.

Figure 6B:
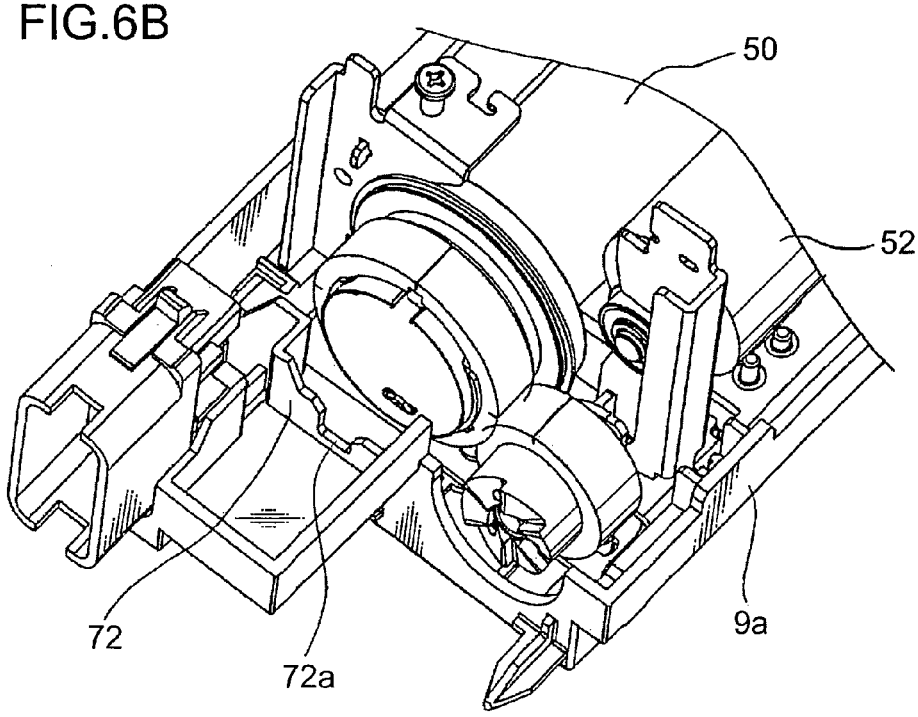
FIG. 6B is a perspective view similar to that of FIG. 6A, but the heater being removed.

In the remote support wall 72, as shown in FIGS. 6A and 6B, the small boss portion of the insulator 66 is placed in the attachment recess 72*a* but no fixed engagement exists between the insulator 66 and the support wall 72, so that the insulator 66 can move or slide in the axial direction to absorb a thermal expansion of the heater 60.

The assembly of heaters 60, 60 is attached to the support walls 72 without using any fastening members such as screws merely by engaging the groove 71 with the extensive portion 72*c* of the support wall 72. Accordingly, the attachment of heaters can be performed more easily in a limited space because any attachment tool is not used.

Also, a plurality of heaters (two heaters in this embodiment) are unified into a single body by the insulators provided on the both ends of the heaters. Comparing to handling of a plurality of heaters individually, accordingly, the attachment of them can performed more easily without taking delicate care for the relative space between heaters. The attachment of a plurality of heaters can be completed in a shorter time.

Next, modified attaching arrangements of heaters will be described with reference to FIGS. 7 to 10. It should be noted that parts or members identical to those of the foregoing embodiment are given like numerals to omit detailed description of them.

Figure 7:
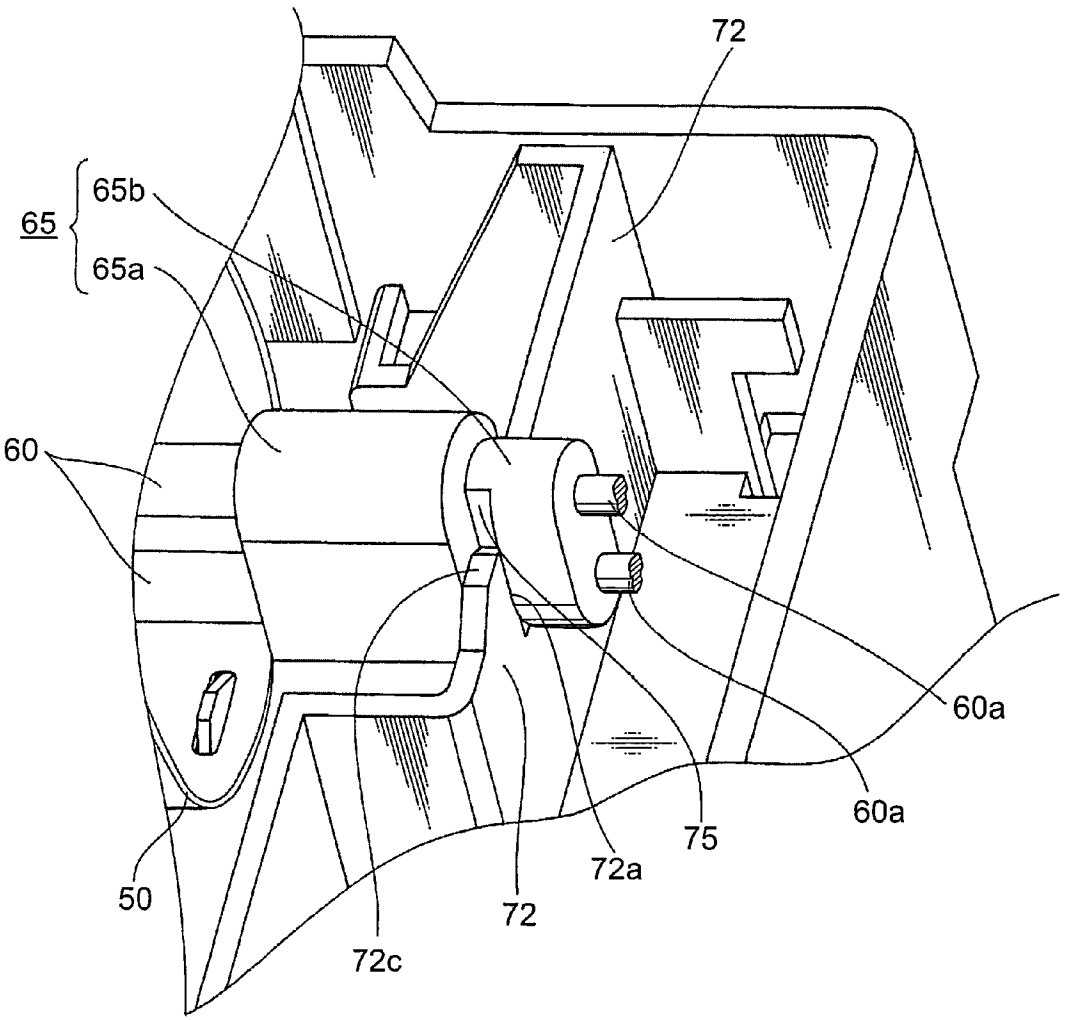
FIG. 7 is a perspective view similar to that of FIG. 5, showing a modified attaching arrangement of a heater to a support frame.

FIG. 7 shows a modified attaching arrangement of a heater to a support frame. This modification is identical to the foregoing embodiment except for a groove 75. The groove 75 is formed in one long surface of a small boss portion 65*b* of an insulator 65. The groove 75 has substantially the same width as the thickness of an extensive portion 72*c* of a support wall 72. The heater assembly is attached to the support wall 72 by inserting the small boss portion 65*b* into a attachment recess 72*a* formed in the support wall. In this time, the groove 75 engages with an extensive projection 72*c* formed on an upper edge of the U-shaped attachment recess 72*a*. In this way, the insulator 65 is easily attached to the support wall 72, and firmly held on the support wall 72 without moving or shifting in the axial and radial directions to thereby keep the insulator 65 in a predetermined position to suppress the shifting of the heaters 60.

Figure 8:
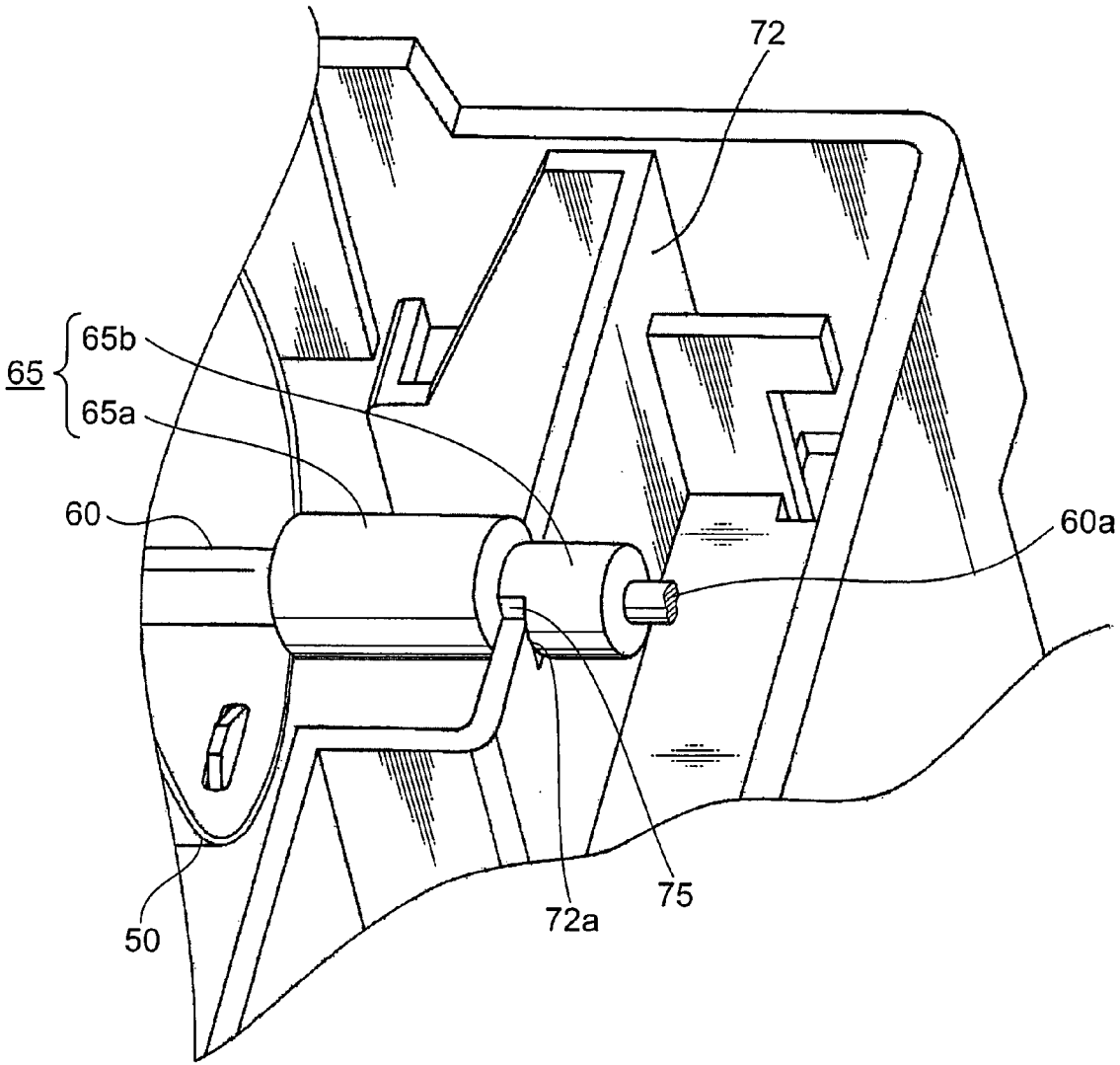
FIG. 8 is a perspective view similar to that of FIG. 5, showing another modified attaching arrangement of a heater to a support frame.

FIG. 8 shows another modified attaching arrangement of a heater to a support frame. This modification is identical to the modification of FIG. 7 but a single heater 60 is provided in place of the two heaters 60, 60. In this modification, large and small boss portions 65*a* and 65*b* have a circular section. Grooves 75 are formed in the opposite portions of the small boss portion 65*b*, and have substantially the same width as the thickness of a support wall 72. The heater assembly is attached to the support wall 72 in the same way as the foregoing embodiment and modification.

Figure 9:
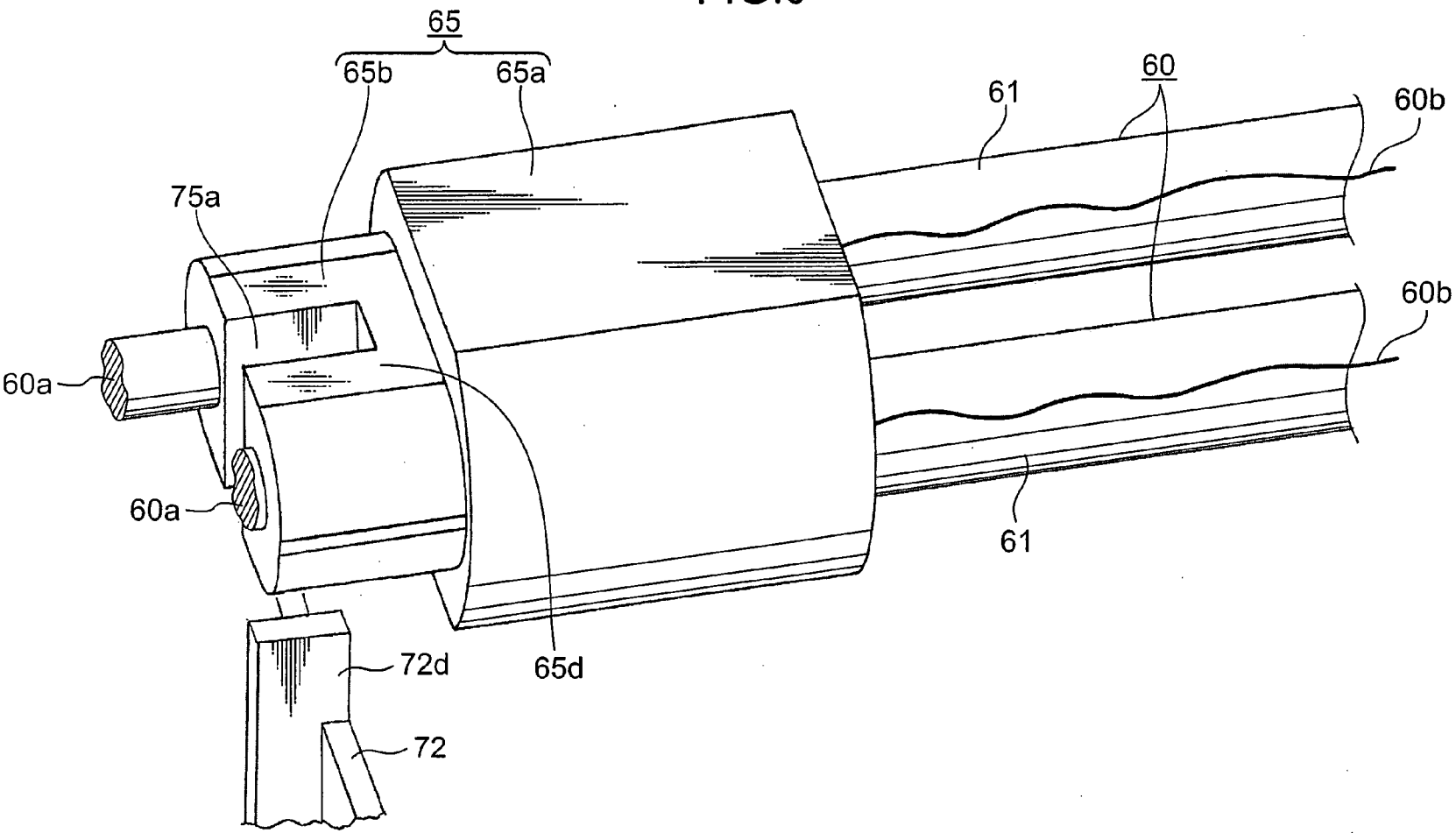
FIG. 9 is a perspective view similar to that of FIG. 3, showing still another modified attaching arrangement of a heater to a support frame.

FIG. 9 shows still another modified attaching arrangement of a heater to a support frame. The basic construction of this arrangement is identical to that of the foregoing embodiment and modification. In this modification, however, a recess 75*a* is formed in the opposite flat surfaces 65*d* of a small boss portion 65*b* of an insulator 65. On the other hand, a support wall 72 is formed with a buttress wall 72*d*. The buttress wall 72*d* has an extensive portion extending from a top edge of the support wall 72. The width of the recess 75*a* is substantially the same as that of the buttress wall 72*d*. An assembly of heaters 60, 60 is attached on the support wall 72 by engaging the recess 75*a* with the extensive portion of the buttress wall 72*d*. An inner end of the extensive portion of the buttress wall 72*d* comes into contact with an inner wall of the recess 75*a* when the heater assembly is attached onto the support wall 72. Accordingly, the heater assembly is kept from moving or shifting in an axially outward direction and radial directions although being not kept from moving or shifting in an axially inward direction. However, this modification assures much easier attachment.

Figure 10:
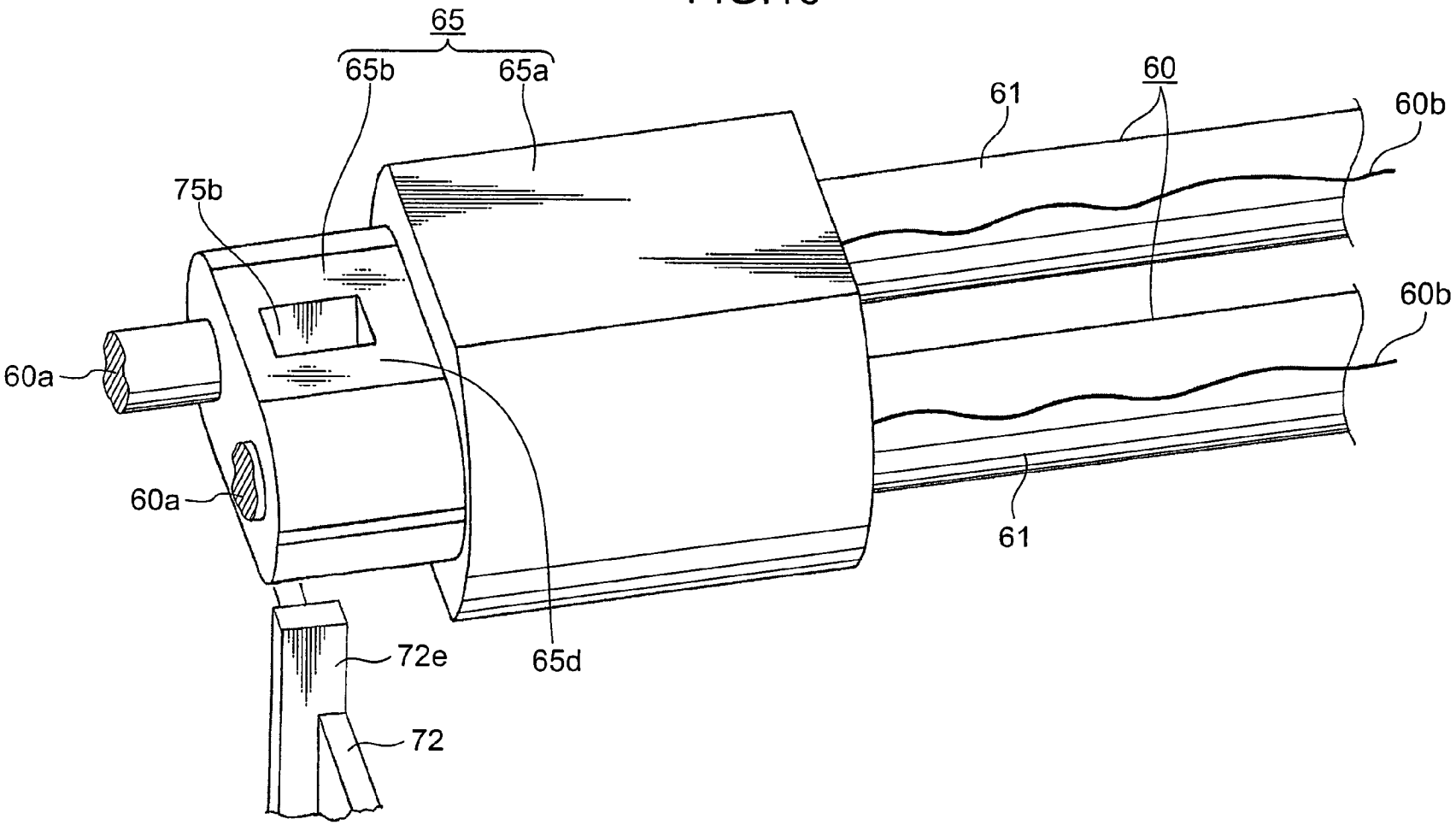
FIG. 10 is a perspective view similar to that of FIG. 3, showing yet still another modified attaching arrangement of a heater to a support frame.

FIG. 10 shows yet still another modified attaching arrangement of a heater to a support frame. This modification is identical to that of FIG. 9, but a hole 75*b* is formed in the opposite flat surfaces 65*d* in place of the recess 75*a*. The width and length of an extensive portion of a buttress wall 72*e* are substantially the same as those of the hole 75*b*. An assembly of heaters 60, 60 is attached on the support wall 72 by engaging the hole 75*b* with the extensive portion of the buttress wall 72*e*. In this modification, the heater assembly is kept from moving or shifting in the axial directions as well as in the radial directions, so that the insulator 65 can be firmly attached on the support wall 72.

In the foregoing embodiment and modifications, the single fixing roller 50 and the single pressing roller 52 constitute a toner fixation arrangement, and the heaters 60, 60 are arranged through the fixing roller 50. However, the present invention is not limited to such arrangement, but applicable to other toner fixation arrangements shown in FIGS. 11A to 11G.

Figure 11A:
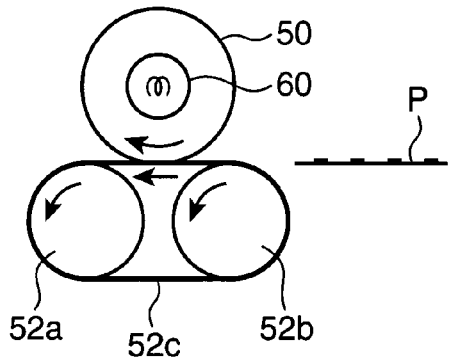
FIGS. 11A to 11G are schematic diagrams showing modified combinations of a fixing roller, a pressing roller, and a heating member.

Specifically, FIG. 11A shows a toner fixation arrangement comprising a fixing unit including a fixing roller 50 and a pressing unit including a pair of rollers 52*a* and 52*b* and a pressing endless belt 52*c*. The single fixing roller 50 comes into contact with the pressing endless belt 52*c*. The pressing endless belt 52*c* is given tension by the rollers 52*a* and 52*b*. The pressing endless belt 52*c* is allowed to rotate with the rotation of the fixing roller 50 which is driven by a driver means provided near an end of the fixing roller 50, and the rollers 52*a* and 52*b* are allowed to rotate following the rotation of the pressing belt 52*c*. A heater 60 is arranged through the fixing roller 50. A toner fixation onto a recording sheet P is accomplished by a pressing force between the heated fixing roller 50 and the pressing belt 52*c*.

Figure 11B:
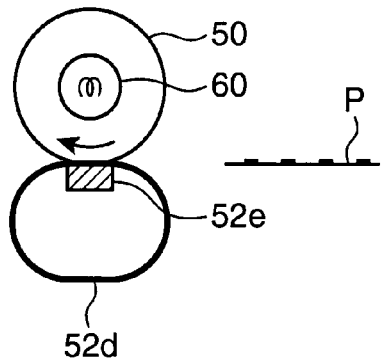

FIG. 11B shows a toner fixation arrangement comprising a fixing unit including a fixing roller 50 and a pressing unit including a pressing endless belt 52*d* and a presser pad 52*e*. The single fixing roller 50 comes into contact with the pressing endless belt 52*d*. The presser pad 52*e* is provided in the pressing endless belt 52*d* and serves to press the pressing belt 52*d* against the fixing roller 50. The fixing roller 50 is driven by a driver means provided near an end of the fixing roller 50. A heater 60 is arranged through the fixing roller 50. A toner fixation onto a recording sheet P is accomplished by a pressing force between the heated fixing roller 50 and the pressing belt 52*d*.

Figure 11C:
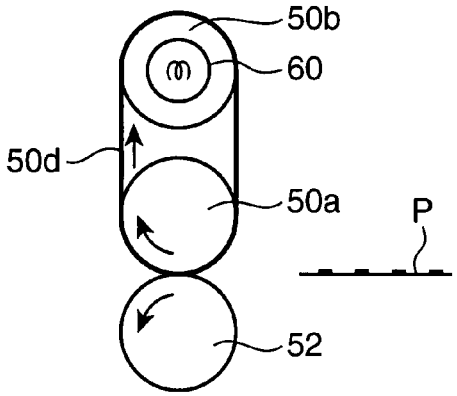

FIG. 11C shows a toner fixation arrangement which is comprised of a fixing unit including a fixing roller 50*a*, a heating roller 50*b*, a transmission endless belt 50*d*, and a heater 60 arranged through the heating roller 50*b*, and a pressing unit including a pressing roller 52. The pressing roller 52 is driven by a driver means provided near an end of the pressing roller 52, and the transmission endless belt 50*d* is driven by the pressing roller 52. The fixing roller 50*a* and the heating roller 50*b* are allowed to rotate following the rotation of the transmission endless belt 50*d*. The heater 60 heats the heating roller 50*b*. The transmission endless belt 50*d* transmits the heat of the heating roller 50*b* to the fixing roller 50*a*. A toner fixation onto a recording sheet P is accomplished by a pressing force between the fixing roller 50*a* and the pressing roller 52 and the heat imparted to the transmission endless belt 50*d*.

Figure 11D:
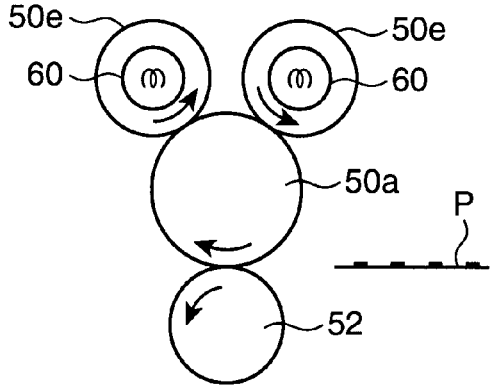

FIG. 11D shows a toner fixation arrangement which is comprised of a fixing unit including a fixing roller 50*a*, two heating rollers 50*e*, 50*e*, and heaters 60 arranged through the heating rollers 50*e*, 50*e*, respectively, and a pressing unit including a pressing roller 52. Each heater 60 heats the heating roller 50*e*. The fixing roller 50*a* is driven by a driver means provided near an end of the fixing roller 50*a*, the two heating rollers 50*e*, 50*e*, and the pressing roller 52 are driven by the fixing roller 50*a*. The heating rollers 50*e*, 50*e* rotate together with rotation of the fixing roller 50*a* while transmitting the heat generated by the heater 60 to the fixing roller 50*a*. A toner fixation onto a recording sheet P is accomplished by a pressing force between the heated fixing roller 50*a* and the pressing roller 52.

Figure 11E:
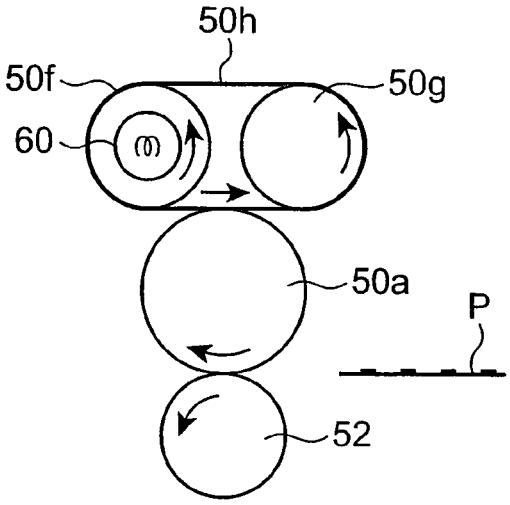

FIG. 11E shows a toner fixation arrangement which is comprised of a fixing unit including a fixing roller 50*a*, a heating roller 50*f*, a tension roller 50*g*, and a transmission endless belt 50*h*, and a pressing unit including a pressing roller 52. The fixing roller 50*a* is driven by a driver means provided near an end of the fixing roller 50*a*. The heater 60 is arranged through the heating roller 50*f* to impart the heat generated by the heater 60 to the transmission belt 50*h* by the way of the heating roller 50*f*. The fixing roller 50*a* is heated by the transmission belt 50*h*. A toner fixation onto a recording sheet P is accomplished by a pressing force between the heated fixing roller 50*a* and the pressing roller 52.

Figure 11F:
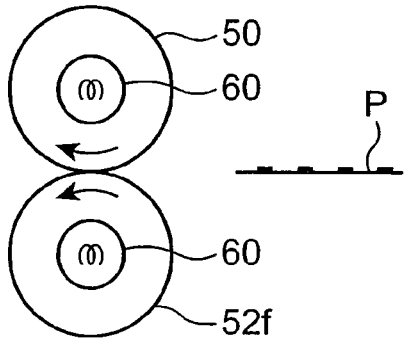

FIG. 11F shows a toner fixation arrangement comprising a fixing roller 50 and a pressing roller 52*f*. Heaters 60, 60 are arranged through the fixing roller 50 and the pressing roller 52*f*, respectively. The fixing roller 50 is driven by a driver means provided near an end of the fixing roller 50, and the pressing roller 52*f* is allowed to rotate with the rotation of the fixing roller 50. The fixing roller 50 and the pressing roller 52*f* are both heated by the respective heaters 60, 60 to perform toner fixation onto a recording sheet P by the both heated rollers 50 and 52*f*.

Figure 11G:
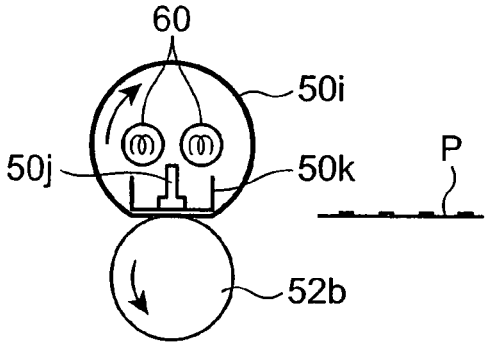

FIG. 11G shows a toner fixation arrangement which is comprised of a fixing unit including a fixing endless belt 50*i* and a pressing unit including a pressing roller 52*b*. Two heaters 60, 60 are arranged through the fixing belt 50*i* to heat the fixing belt 50*i*. The fixing belt 50*i* is pressed by means of a pressing member 50*j* provided within the fixing belt 50*i*. A guide member 50*k* is provided between the pressing member 50*j* and the fixing belt 50*i* to flatten the fixing belt 50*i* over a certain region including a contact position with the pressing roller 52*b*. The pressing roller 52*b* is driven by a driver means provided near an end of the pressing roller 52*b*. A toner fixation onto a recording sheet P is accomplished by a pressing force between the heated fixing belt 50*i* and the pressing belt 52*b*.

As described above, a fixing device is used in an image forming apparatus, and includes: a pair of a fixing unit and a pressing unit for performing fixation of a toner image on a recording sheet; a support frame for supporting the fixing unit and a pressing unit; and a heater for generating heat for the fixation. The heater has a cylindrical shape, and is provided with an insulator on at least one of the opposite ends thereof. The insulator has a retaining space operable to fixedly engage with a portion of the support frame.

It may be preferable to provide the support frame with a support wall having an attachment recess, and provide the insulator with a boss portion engageable with the attachment recess, and form the retaining space in the boss portion, the retaining space being operable to engage with an end of the support wall that defines the attachment recess.

The boss portion may preferably include a large boss portion and a small boss portion having a smaller sectional area, the small boss portion being formed with a projection to define the retaining space between the projection and the large boss portion.

The retaining space may be preferably a groove formed in the boss portion.

It may be preferable to provide the support frame with a support wall having an attachment projection, and form a recess as the retaining space, the recess being formed in the insulator and operable to engage with the attachment projection.

It may be preferable to provide the support frame with a support wall having an attachment projection, and form a hole as the retaining space, the hole being formed in the insulator and operable to engage with the attachment projection.

The fixing device may be further provided with another heater having a cylindrical shape for generating heat for toner fixation. The two heaters may be preferably united by a single insulator in a state that a certain relative space is held between them.

The fixing device may be preferably further provided with a second insulator on the other end of the heater, the second insulator being slidably attached on the support frame.

It may be preferable that the fixing unit includes a fixing roller and a driver for driving the fixing roller, and the pressing unit includes a pair of rollers and a pressing endless belt provided between the rollers and made pressing contact with the fixing roller to rotate with the rotation of the fixing roller, and the heater is arranged through the fixing roller.

It may be preferable that the fixing unit includes a fixing roller and a driver for driving the fixing roller, the pressing unit includes a pressing endless belt and a presser member for pressing the pressing endless belt against the fixing roller, the pressing endless being rotatable with the rotation of the fixing roller, and the heater is arranged through the fixing roller.

It may be preferable that the fixing unit includes a fixing roller, a heating roller, and a transmission endless belt provided between the fixing roller and the heating roller, and the pressing unit includes a pressing roller made pressing contact with the transmission endless belt of the fixing unit, and a driver for driving the pressing roller, and the heater is arranged through the heating roller of the fixing unit.

It may be preferable that the fixing unit includes a fixing roller and a heating roller made contact with the fixing roller, and a driver for driving the fixing roller, and the pressing unit includes a pressing roller made pressing contact with the fixing roller, and the heater is arranged through the heating roller of the fixing unit.

It may be preferable that the fixing unit includes a fixing roller, a heating roller, a tension roller, and a transmission endless belt provided between the heating roller and the tension roller and made contact with the fixing roller, and a driver for driving the fixing roller, and the pressing unit includes a pressing roller made pressing contact with the fixing roller, and the heater is arranged through the heating roller of the fixing unit.

It may be preferable that the fixing unit includes a fixing roller and a driver for driving the fixing roller, the pressing unit includes a pressing roller made pressing contact with the fixing roller, and heaters are arranged through the fixing roller and the pressing roller, respectively.

It may be preferable that the fixing unit includes a fixing endless belt, a pressing member provided within the fixing endless belt, and a guide member provided between the pressing member and the fixing belt for flattening the fixing belt 50*i* over a certain region, and the pressing unit includes a pressing roller made pressing contact with the fixing endless belt, and a driver for driving the pressing roller, and the heater is arranged through the fixing endless belt of the fixing unit.

Also, an image forming apparatus is provided with the above-mentioned fixing device.

With these fixing devices, the cylindrical heater is provided with an insulator on at least one of the opposite ends thereof. The insulator is formed with a retaining space to fixedly engage with a portion of the support frame. The one end of the heater is fixedly attached. Accordingly, the heater is kept from moving or shifting on the one end, thereby assuring accurate detection of a temperature of the heater by a temperature sensor because the shifting of the heater in an axial direction can be suppressed greatly.

The attachment of the one end of the heater is accomplished by engaging the retaining space with a portion of the support frame. Thus, the attachment of the heater can be easily performed without using any mechanical fasteners.

In the fixing device where the support wall is formed with an attachment recess and the retaining space is formed in the boss portion engageable with the attachment recess, the attachment of the one end of the heater can be done by placing the boss portion in the attachment recess and engaging the retaining space with the end of the support wall. This is very easily operation.

In the fixing device where the support wall is formed with an attachment projection and the retaining space is formed in the insulator, the attachment of the one end of the heater can be done by engaging the retaining space with the attachment projection. This is very easily operation.

In the fixing device having a plurality of heaters, the plurality of heaters are unified by a single insulator in a state that a certain relative space is held between them. Accordingly, the plurality of heaters can be easily attached on the support frame.

In the fixing device where a slidable second insulator is provided on the other end of the heater, a thermal expansion can be absorbed in the simple construction.

Further, the variety of toner fixation arrangements mentioned above that are provided with the inventive heater attaching arrangements can perform the toner fixation under the excellent operating conditions.

Moreover, the image forming apparatus that is provided with the inventive fixing device can be produced at a reduced cost, and performs the excellent image forming.

In the foregoing embodiment, two heaters 60 are provided. However, it may be appreciated to provide three or more heaters. The insulator 65, the attachment recess 72*a*, and the attachment projection 72*d* may be modified into other shape or configuration than those shown in the foregoing.

Further, in the foregoing embodiment, the fixing device is mounted on the tandem electrophotographic type color copying machine. However, it is needless to say that the fixing device may be used for single drum type color copying machines, monographic copying machines, printers, facsimile machines, and other image forming apparatus.

This application is based on patent application No. 2006-114655 filed in Japan, the contents of which are hereby incorporated by references.

Although the present invention has been fully described by way of example with reference to the accompanied drawings, it is to be understood that various changes and modifications will be apparent to those skilled in the art. Therefore, unless otherwise such changes and modifications depart from the scope of the present invention hereinafter defined, they should be construed as being included therein.

What is claims is:

1. A fixing device comprising:

a pair of a fixing unit and a pressing unit for performing fixation of a toner image on a recording sheet;

a support frame for supporting the fixing unit and the pressing unit, the support frame including a support wall formed with an attachment recess; and a heater for generating heat for the fixation, the heater having a substantially cylindrical shape, and being provided with an insulator on at least one of opposite ends thereof, the insulator includes a large boss portion and a small boss portion having a smaller sectional area than the large boss portion, the small boss portion being formed with a projection; and a retaining space defined between the projection and the large boss portion, the retaining space being operable to engage with an end of the support wall that defines the attachment recess.

2. The fixing device according to claim 1, wherein the retaining space is a groove formed between the projection the large boss portion.

3. A fixing device comprising:

a pair of a fixing unit and a pressing unit for performing fixation of a toner image on a recording sheet;

a support frame for supporting the fixing unit and the pressing unit, the support frame includes support wall formed with an attachment projection; and a heater for generating heat for the fixation, the heater having a substantially cylindrical shape with opposite first and longitudinal ends spaced from one another along a longitudinal direction, and being provided with an insulator on at least one of the opposite ends thereof, the insulator having a retaining space extending into the insulator in a direction substantially transverse to the longitudinal direction, the retaining space being operable to fixedly engage with a portion of the support frame, the retaining space being a hole which is formed in the insulator, and is operable to engage with the attachment projection.

4. The fixing device according to claim 1, wherein the heater is a first heater, the fixing device further comprising a second heater having a substantially cylindrical shape for generating heat for toner fixation, the first and second heaters being united by a single insulator in a state that a certain relative space is held between the first and second heaters.

5. The fixing device according to claim 1, wherein the insulator and the fixing device further comprising a second insulator provided on the end of the heater opposite the first insulator, the second insulator being slidably attached on the support frame.

6. The fixing device according to claim 1, wherein:

the fixing unit includes a fixing roller, and a driver for driving the fixing roller;

the pressing unit includes a pair of rollers and a pressing endless belt provided between the rollers and made pressing contact with the fixing roller to rotate with the rotation of the fixing roller; and the heater is arranged through the fixing roller.

7. The fixing device according to claim 1, wherein:

the fixing unit includes a fixing roller, and a driver for driving the fixing roller;

the pressing unit includes a pressing endless belt and a presser member for pressing the pressing endless belt against the fixing roller, the pressing endless belt being rotatable with the rotation of the fixing roller; and the heater is arranged through the fixing roller.

8. The fixing device according to claim 1, wherein:

the fixing unit includes a fixing roller, a heating roller, and a transmission endless belt provided between the fixing roller and the heating roller;

the pressing unit includes a pressing roller made pressing contact with the transmission endless belt of the fixing unit, and a driver for driving the pressing roller; and the heater is arranged through the heating roller of the fixing unit.

9. The fixing device according to claim 1, wherein:

the fixing unit includes a fixing roller and a heating roller made contact with the fixing roller, and a driver for driving the fixing roller;

the pressing unit includes a pressing roller made pressing contact with the fixing roller; and the heater is arranged through the heating roller of the fixing unit.

10. The fixing device according to claim 1, wherein:

the fixing unit includes a fixing roller, a heating roller, a tension roller, and a transmission endless belt provided between the heating roller and the tension roller and made contact with the fixing roller, and a driver for driving the fixing roller;

the pressing unit includes a pressing roller made pressing contact with the fixing roller; and the heater is arranged through the heating roller of the fixing unit.

11. The fixing device according to claim 1, wherein:

the fixing unit includes a fixing roller and a driver for driving the fixing roller;

the pressing unit includes a pressing roller made pressing contact with the fixing roller; and heaters are arranged through the fixing roller and the pressing roller, respectively.

12. The fixing device according to claim 1, wherein:

the fixing unit includes a fixing endless belt, a pressing member provided within the fixing endless belt, and a guide member provided between the pressing member and the fixing endless belt for flattening the fixing endless belt over a certain region;

the pressing unit includes a pressing roller made pressing contact with the fixing endless belt, and a driver for driving the pressing roller; and the heater is arranged through the fixing endless belt of the fixing unit.

13. An image forming apparatus comprising:

a fixing device including:

a pair of a fixing unit and a pressing unit for performing fixation of a toner image on a recording sheet;

a support frame for supporting the fixing unit and the pressing unit, the support frame including a support wall formed with an attachment recess; and a heater for generating heat for the fixation, the heater having a substantially cylindrical shape with opposite first and longitudinal ends spaced from one another along a longitudinal direction, and being provided with an insulator on at least one of the opposite ends thereof, the insulator having a large boss portion and a small boss portion having a smaller sectional area than the large boss portion, the small boss portion being formed with a projection, and a retaining space defined between the projection and the large boss portion and extending into the insulator in a direction substantially transverse to the longitudinal direction, the retaining space being operable to fixedly engage with an end of the support wall that defines the attachment recess.

14. The image forming apparatus according to claim 13, wherein the heater is a first heater, and the fixing device further includes a second heater having a substantially cylindrical shape for generating heat for toner fixation, the first and second heaters being united by a single insulator in a state that a certain relative space is held between the first and second heaters.

15. The image forming apparatus according to claim 13, wherein the fixing device further includes a second insulator provided on the second end of the heater, the second insulator being slidably attached on the support frame.

16. An image forming apparatus comprising:

a fixing device including:

a pair of a fixing unit and a pressing unit for performing fixation of a toner image on a recording sheet;

a support frame for supporting the fixing unit and the pressing unit, the support frame including a support wall formed with an attachment projection; and a heater for generating heat for the fixation, the heater having a substantially cylindrical shape with opposite first and longitudinal ends spaced from one another along a longitudinal direction, and being provided with an insulator on at least one of the opposite ends thereof, the insulator having a retaining space extending into the insulator in a direction substantially transverse to the longitudinal direction, the retaining space being operable to fixedly engage with a portion of the support frame, the retaining space is a hole which is formed in the insulator, and operable to engage with the attachment projection.

* * * * *